US012108850B2

(12) United States Patent
Skuse

(10) Patent No.: US 12,108,850 B2
(45) Date of Patent: Oct. 8, 2024

(54) WALKING CANE

(71) Applicant: Upperstate LLC, Boston, MA (US)

(72) Inventor: Brian Skuse, Boston, MA (US)

(73) Assignee: Upperstate LLC, Boston, MA (US)

( * ) Notice: Subject to any disclaimer, the term of this patent is extended or adjusted under 35 U.S.C. 154(b) by 164 days.

(21) Appl. No.: 17/836,504

(22) Filed: Jun. 9, 2022

(65) Prior Publication Data

US 2023/0397702 A1 Dec. 14, 2023

(51) Int. Cl.
*A45B 9/00* (2006.01)
*A45B 9/02* (2006.01)

(52) U.S. Cl.
CPC ..... *A45B 9/00* (2013.01); *A45B 9/02* (2013.01); *A45B 2009/007* (2013.01)

(58) Field of Classification Search
CPC ..... A45B 9/00; A45B 2009/007
See application file for complete search history.

(56) References Cited

U.S. PATENT DOCUMENTS

| | | | |
|---|---|---|---|
| 2,705,015 | A | 3/1955 | Langlais |
| 3,350,111 | A | 10/1967 | Sahlein et al. |
| 3,378,272 | A | 4/1968 | Lewis |
| D274,100 | S | 6/1984 | Axton |
| 4,533,140 | A | 8/1985 | Champion |
| D292,346 | S | 10/1987 | Kolomeyer |
| D297,887 | S | 10/1988 | Hattersley |
| 4,887,625 | A | 12/1989 | Archer |
| D309,933 | S | 8/1990 | Brown, Jr. |
| 5,036,873 | A | 8/1991 | Clayton |
| D342,828 | S | 1/1994 | Steinbach et al. |
| 5,351,703 | A | 10/1994 | Moe et al. |
| 5,577,827 | A | 11/1996 | Leffingwell et al. |
| 5,669,103 | A | 9/1997 | Hen |
| D396,742 | S | 8/1998 | Raymond |
| D397,393 | S | 8/1998 | Reed |
| D411,034 | S | 6/1999 | Evans |
| D450,440 | S | 11/2001 | Clarke et al. |
| 6,539,965 | B1 | 4/2003 | White, III |
| D479,767 | S | 9/2003 | Mudd |
| 6,782,903 | B1 | 8/2004 | Jarman et al. |

(Continued)

FOREIGN PATENT DOCUMENTS

| | | |
|---|---|---|
| JP | 2011206149 | 10/2011 |
| JP | 3199705 | 9/2015 |
| JP | 2016168074 | 9/2016 |

*Primary Examiner* — Noah Chandler Hawk
(74) *Attorney, Agent, or Firm* — Woods Oviatt Gilman LLP; Katherine H. McGuire, Esq.

(57) ABSTRACT

An adjustable walking cane includes an inner tube slidably received within an outer tube. The inner tube defines a plurality of apertures therethrough. A translating rod assembly having a central fixed rod and a concentrically mounted translating member is also included. An actuating assembly including a button proximate the top end of the outer tube is coupled to a first end of the translating member. A pin assembly is located at the bottom end of the outer tube and has a pin reciprocally translatable between an extended position, where the pin engages a selected aperture of the plurality of apertures defined within the inner tube, and a retracted position where the pin disengages from the outer tube. Application of a force upon the button causes the pin to move from the extended position to the retracted position such that the inner tube slides within the outer tube.

11 Claims, 7 Drawing Sheets

(56) References Cited

U.S. PATENT DOCUMENTS

| | | | |
|---|---|---|---|
| 6,938,927 | B1 | 9/2005 | Martin et al. |
| 7,650,898 | B2 | 1/2010 | Jarman et al. |
| 8,136,542 | B2 | 3/2012 | Warren |
| D685,568 | S | 7/2013 | You |
| 8,479,755 | B2 | 7/2013 | Hung |
| 8,528,577 | B2 | 9/2013 | Pietrzak et al. |
| 8,800,578 | B2 | 8/2014 | Jackson |
| 8,875,724 | B2 | 11/2014 | Nootenboom |
| 8,985,130 | B2 | 3/2015 | Howarth et al. |
| D730,039 | S | 5/2015 | Kizaki |
| 9,044,072 | B2 | 6/2015 | Lindsay, Jr. et al. |
| D734,020 | S | 7/2015 | Chisum |
| D740,015 | S | 10/2015 | Berberian |
| D740,543 | S | 10/2015 | Winters |
| 9,198,488 | B2 | 12/2015 | Pronzati et al. |
| D754,962 | S | 5/2016 | Pennington |
| 9,512,865 | B2 | 12/2016 | Wang |
| 9,609,925 | B2 | 4/2017 | Klaus |
| 9,867,436 | B2 | 1/2018 | Lenhart et al. |
| 9,974,366 | B2 | 5/2018 | Heim |
| 10,092,068 | B2 | 10/2018 | Jung et al. |
| 10,172,427 | B2 | 1/2019 | D'Jay |
| 10,575,607 | B2 | 3/2020 | Bullard |
| D881,550 | S | 4/2020 | Skuse |
| 10,722,010 | B2 | 7/2020 | D'Jay |
| 10,856,630 | B1 | 12/2020 | Hu |
| 10,881,173 | B1 | 1/2021 | Stringham |
| 10,986,903 | B2 | 4/2021 | Liu |
| 2010/0254751 | A1 | 10/2010 | McMillan, III |
| 2012/0145206 | A1 | 6/2012 | Parry et al. |
| 2014/0053887 | A1 | 2/2014 | Lee |
| 2015/0374081 | A1 | 12/2015 | Wang et al. |
| 2017/0224072 | A1 | 8/2017 | Van Varick et al. |

WALKING CANE

FIELD OF THE INVENTION

The present invention relates to a walking cane, more particularly to a height adjustable walking cane, and still more particularly to an expandable and collapsible height adjustable walking cane that uses spring-actuated expansion and an internal latch mechanism to lock the walking cane at a desired height.

BACKGROUND OF THE INVENTION

The elderly and those with medical ailments such as back pain, leg pain or loss, Parkinson's disease, and those undergoing cancer treatments frequently require the use of one or more walking canes for mobility assistance. However, walking canes have limited length and may not provide adequate support and stability to the user in all situations. While standardly available canes may be adequate for general purposes, a user may still require a longer or shorter device on occasion. Height-adjustable canes may use a twist-to-tighten/loosen mechanism to adjust telescopic tubes forming the cane to a desired length. This mechanism may be suitable for most users, but can be cumbersome for someone with arthritis, visual impairment, Parkinson's disease or anyone with hand dexterity issues. As a result, activities such as walking, hiking or traveling by cars or planes may be arduous where the cane length may need to be periodically adjusted. In such instances, the cane may turn into a nuisance as much as a benefit.

From the above, it is apparent that there is a need for a mobility device that offers quick and easy adjustability while also providing the desired support and stability. The present invention addresses these and other needs.

BRIEF SUMMARY OF THE INVENTION

In general, an embodiment the present invention is directed to an expandable and collapsible mobility cane that uses spring-actuated expansion and an internal latch mechanism to lock the cane at a desired height. The actuation may be implemented via a push button located near the handle of the cane.

More specifically, in accordance with as aspect of the present invention, an exemplary embodiment may be directed to a height adjustable walking cane including an outer tube having a top end and a bottom end and defining a pin hole proximate the bottom end. An inner tube is slidably received within the outer tube. The inner tube has an inner tube wall defining a plurality of apertures therethrough. A translating rod assembly having a central fixed rod and a concentrically mounted translating member is also included. An actuating assembly including an actuating button proximate the top end of the outer tube is coupled to a first end of the translating member. A pin assembly is located at the bottom end of the outer tube and has a pin reciprocally translatable between an extended position where the pin engages a selected aperture of the plurality of apertures defined within the inner tube wall and the pin hole defined in the outer tube, and a retracted position where the pin disengages from the pin hole defined in the outer tube. Application of an actuation force upon the actuating button causes the pin to move from the extended position to the retracted position such that the inner tube slidably translates within the outer tube.

In a further aspect of the present invention a handle is mounted to the top end of the outer tube, where the handle slidably secures the actuating button therein. The handle includes a handle grip portion disposed at an angle relative to a longitudinal axis of the outer tube. The handle includes a button cover to prevent unwanted actuation of the actuating button. The actuating assembly resides within at least a portion of the handle and may further include a linkage pivotally mounted to a portion of the handle; a rod driver having a first driver end coupled to the translating member; a button post having a first post end coupled to the actuating button and a second post end coupled to the linkage; and a link arm having a first link end coupled to the linkage and a second link end coupled to the rod driver. Application of the actuation force upon the actuating button drives the button post against the linkage thereby pivoting the linkage and causing the linkage to drive the link arm against the rod driver whereby the rod driver engages the translating member to move the pin from the extended position to the retracted position. The actuating assembly further includes a button spring between the button and the linkage, the button spring biasing the button to an extended button rest position when the actuation force is not applied to the actuating button.

In accordance with still another aspect of the present invention, the pin assembly further includes a pin carrier block fixedly mounted to a distal end of the central fixed rod. The pin carrier block includes a pin bore dimensioned to slidably receive the pin therein and a lock pin passing through a lock pin aperture defined within the pin. Opposing ends of the lock pin are configured to travel within respective carrier slots defined within the pin carrier block. The pin assembly further includes a lower pin travel block coupled to a second end of the translating member, wherein the lower pin travel block defines travel slots therein. The opposing ends of the lock pin are further configured to travel within respective travel slots within the lower pin travel block. The pin assembly further includes a pin assembly spring between the pin carrier block and the lower pin travel block. The pin assembly spring biases the lower pin travel block to the first position. The translating rod assembly further includes a lower bushing coupled to the pin carrier block and the inner tube. A height spring is mounted between the spring cap of the actuating assembly and the lower bushing. The height spring biases the outer tube and the inner tube from the collapsed orientation toward the elongate orientation when the pin is in the retracted position. The carrier slots are disposed at an angle relative to the travel slots.

In another aspect of the present invention, each of the outer tube and the inner tube may define a generally D-shaped cross section having a curved portion and a planar portion. The planar portions are adjacent one another when the inner tube is received within the outer tube. Also, each of the plurality of apertures defined within the inner tube is located within the planar portion.

Additional objects, advantages and novel features of the present invention will be set forth in part in the description which follows, and will in part become apparent to those in the practice of the invention, when considered with the attached figures.

BRIEF DESCRIPTION OF THE DRAWINGS

The accompanying drawings form a part of this specification and are to be read in conjunction therewith, wherein like reference numerals are employed to indicate like parts in the various views, and wherein.

DETAILED DESCRIPTION OF THE INVENTION

Figure 1:
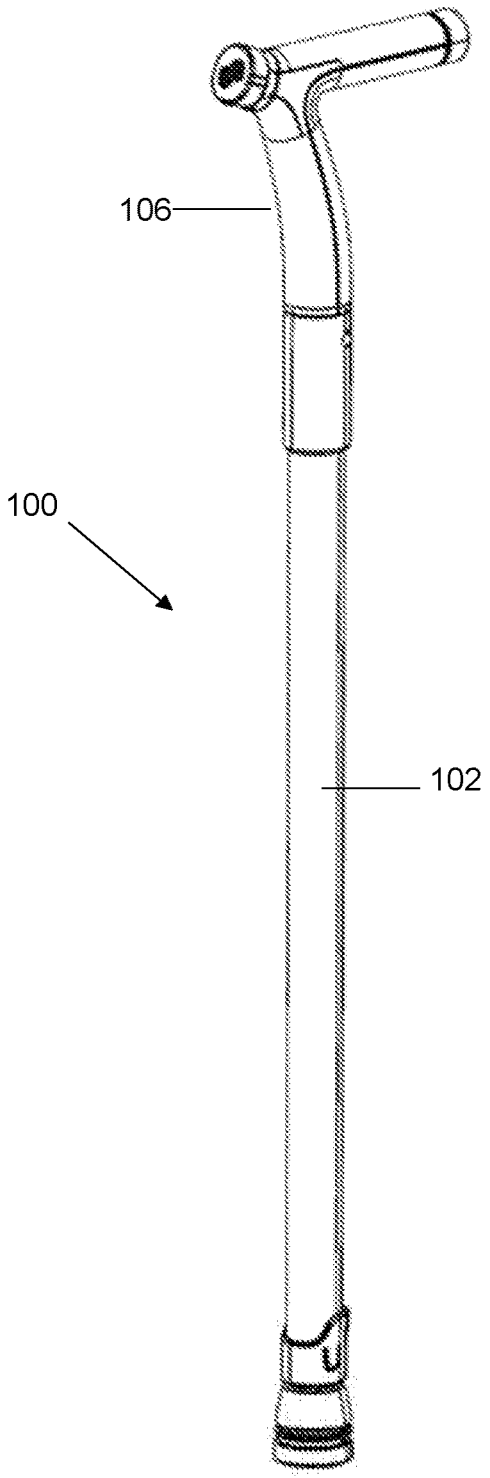
FIG. 1 is a perspective view of an exemplary embodiment of a walking cane in accordance with an aspect of the present invention, with the walking cane in the collapsed orientation.
Figure 2:
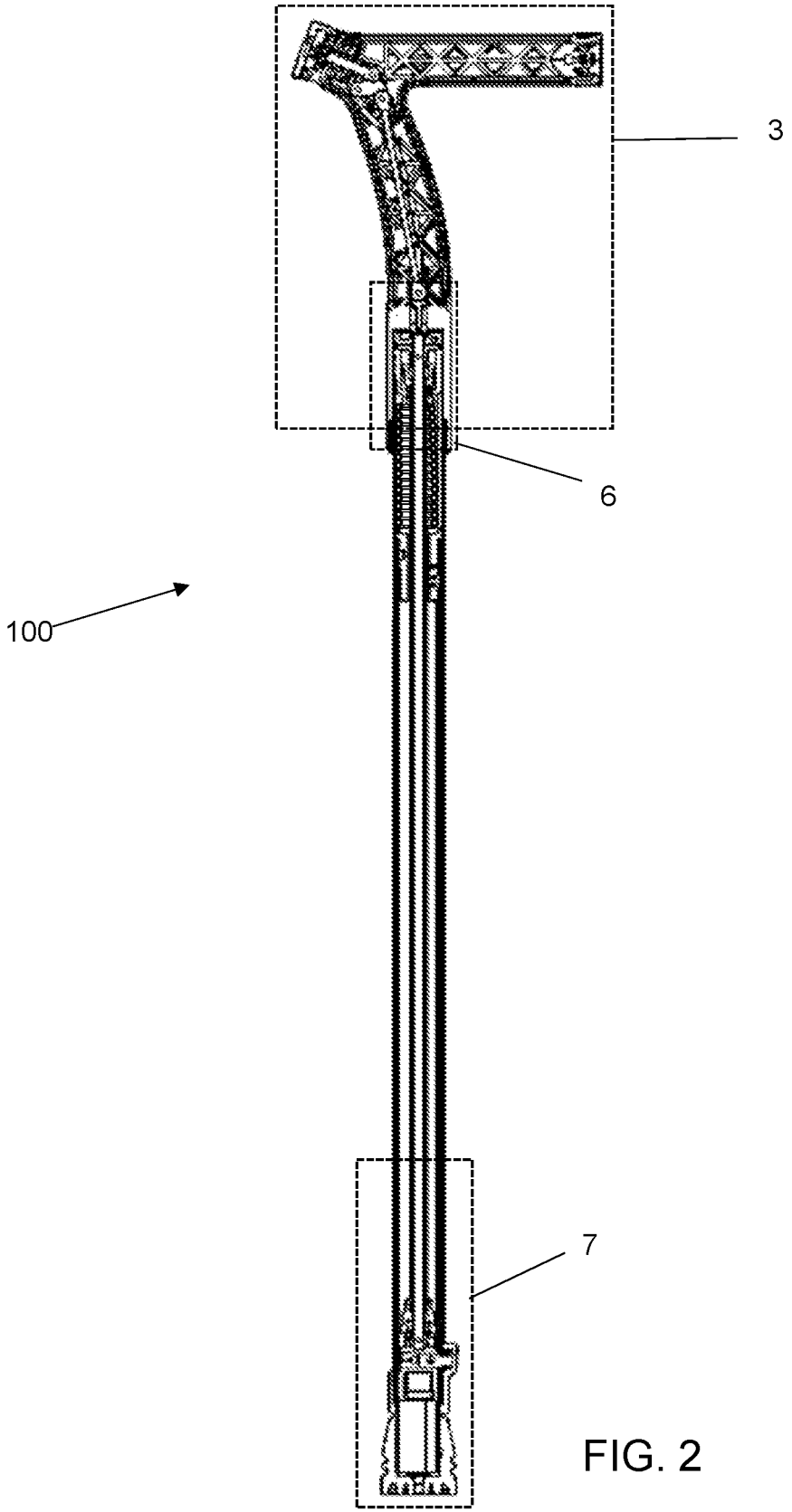
FIG. 2 is a cross section view of the exemplary walking cane shown in FIG. 1.
Figure 3:
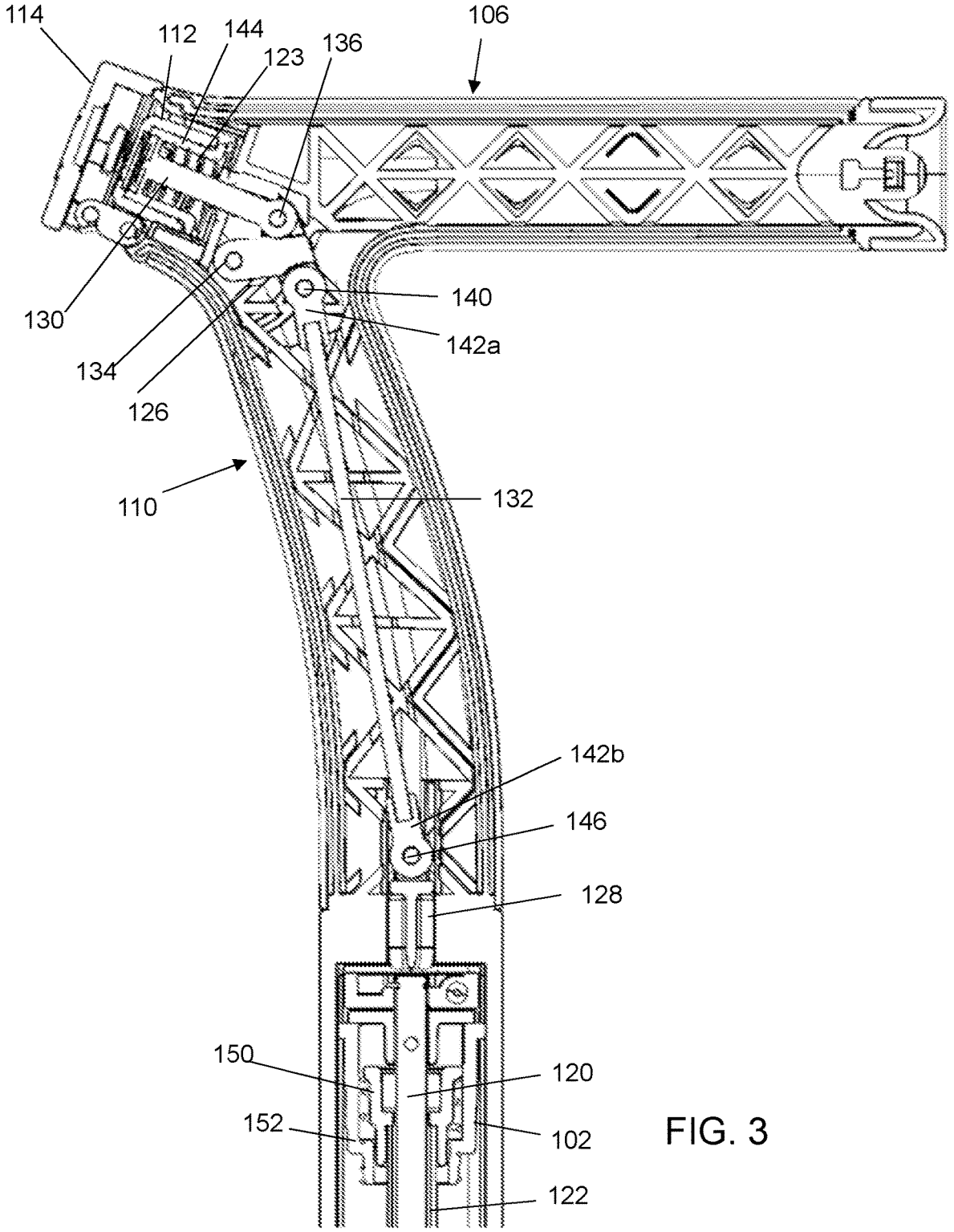
FIG. 3 is an expanded cross section view of an embodiment of a handle portion of the exemplary walking cane shown in FIG. 2 as generally indicated by box 3 in FIG. 2.
Figure 4:
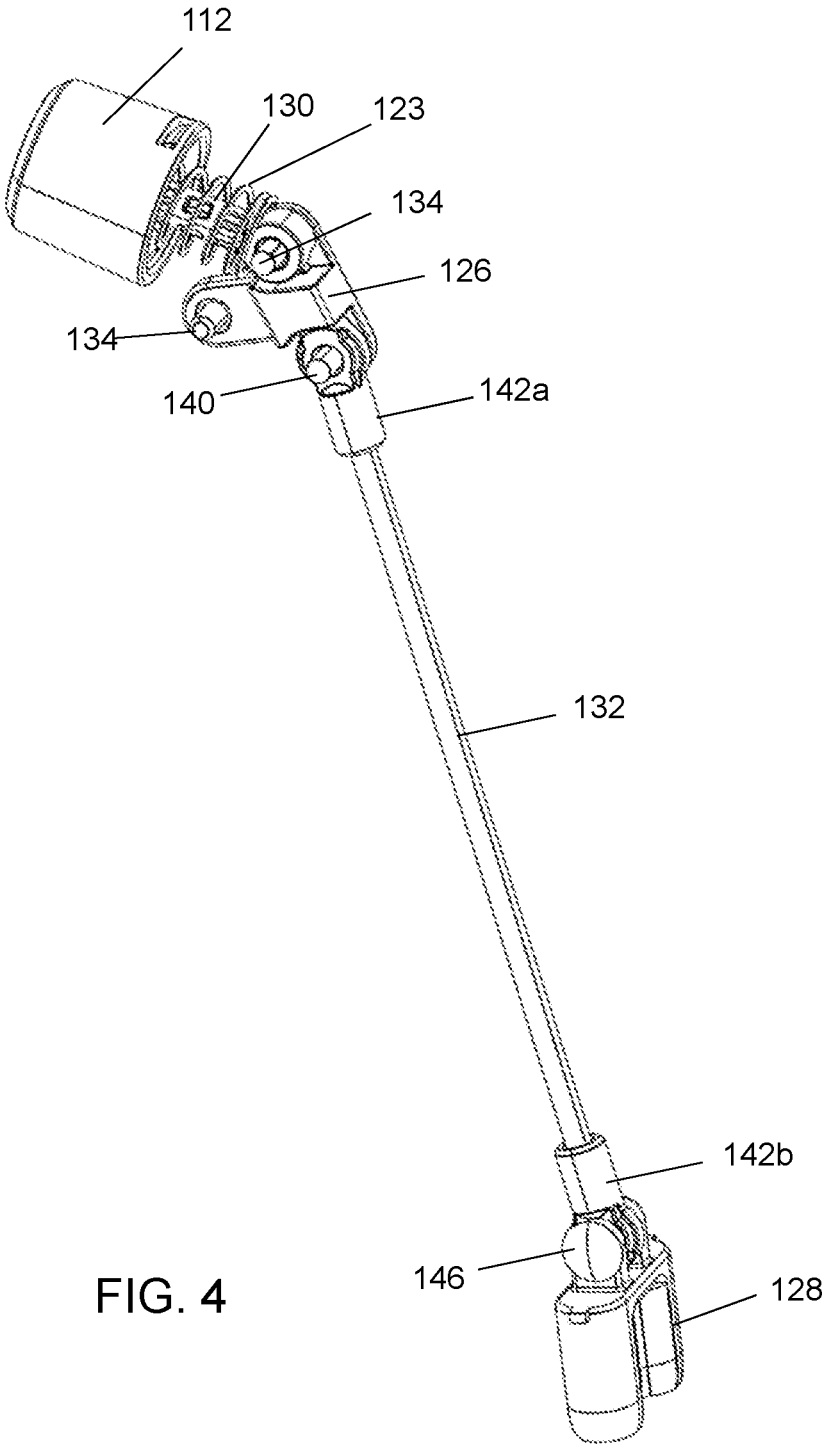
FIG. 4 is an isolated view of an embodiment of an actuating assembly suitable for use with the exemplary walking cane shown in FIG. 1.

Referring to the drawings in detail, and specifically to FIGS. 1-2, a height adjustable walking cane 100 generally includes an inner tube 104 slidably received within an outer tube 102. A handle portion 106 is mounted to top end 108 of outer tube 102 and is adapted for easy, comfortable grip by the cane user. Longitudinal axis $L_H$ of handle portion 106 may be disposed at an angle A with respect to longitudinal axis $L_T$ of outer tube 102. Angle A may be about 90 degrees+/− about 5 degrees. As shown most clearly in FIG. 3, walking cane 100 includes an actuation assembly 110 having an actuating button 112 slidably secured within handle portion 106, the operation of which will be discussed in greater detail below. An optional button cover 114 may also be provided to prevent unwanted or accidental actuation of actuation button 112. In one embodiment, actuation button 112 and button cover 114 may be located proximate to the junction of longitudinal axes $L_H$ and $L_T$.

Figure 1A:
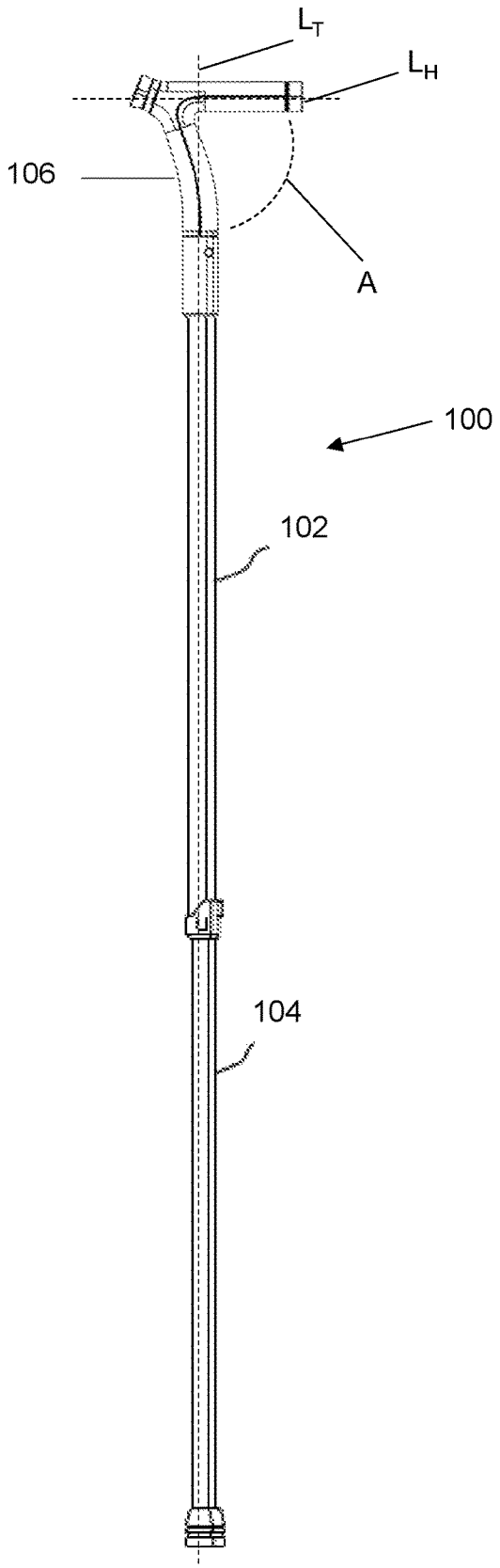
FIG. 1A is a side view of the exemplary walking cane shown in FIG. 1, with the walking cane in the elongate orientation.

As shown in FIG. 1, walking cane 100 may be in a collapsed orientation wherein inner tube 104 is completely (or substantially) resident within outer tube 102. With reference to FIGS. 1A and 1B, actuation (i.e., pushing or depressing) of actuation button 112 may allow inner tube 104 to extend outwardly of outer tube 102 10 a fully elongated orientation (FIG. 1A) or any of a plurality of intermediate orientations as selected by the cane user, as will be discussed below.

Figure 5:
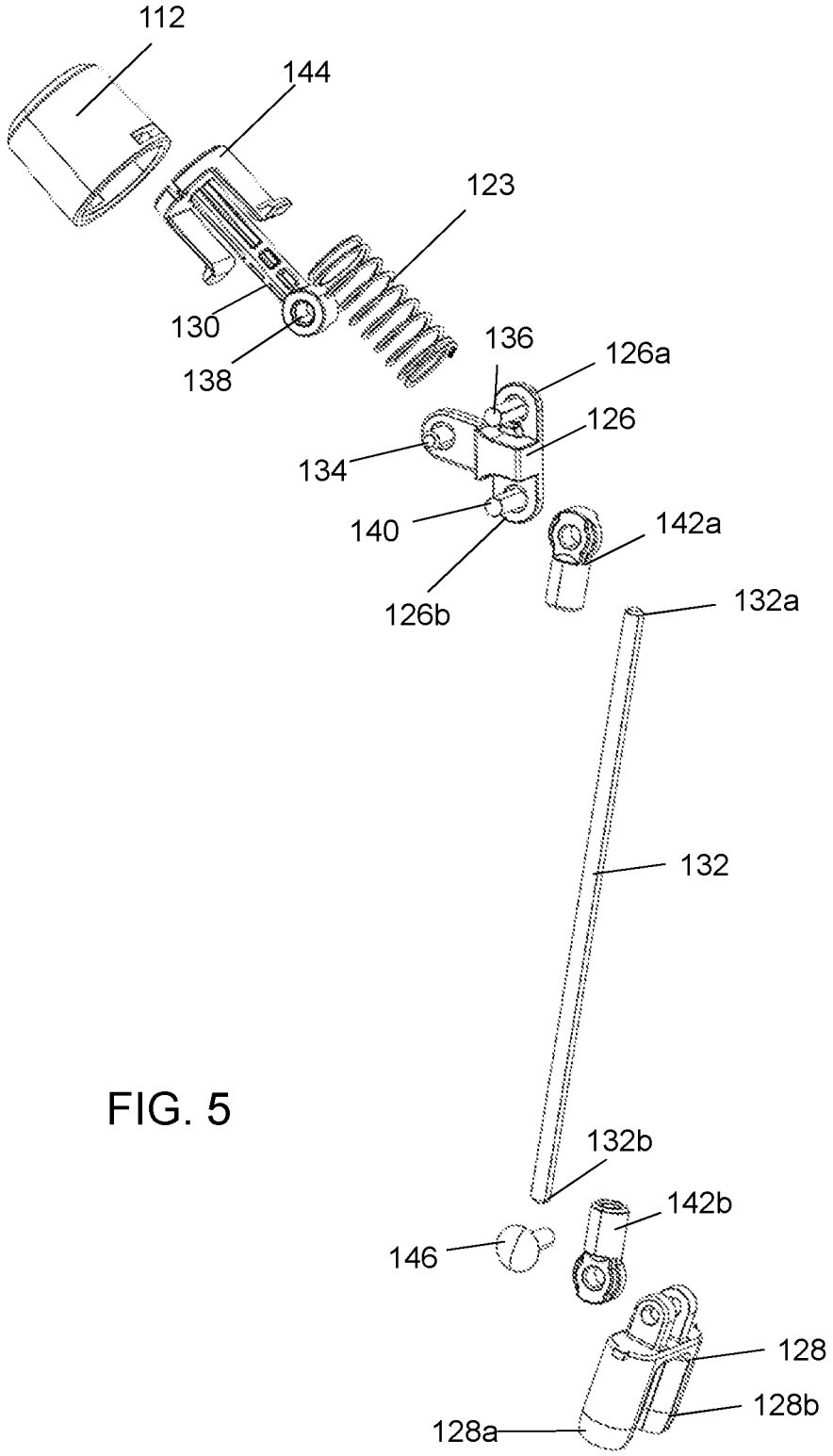
FIG. 5 is an exploded view of the actuating assembly shown in FIG. 4.
Figure 6:
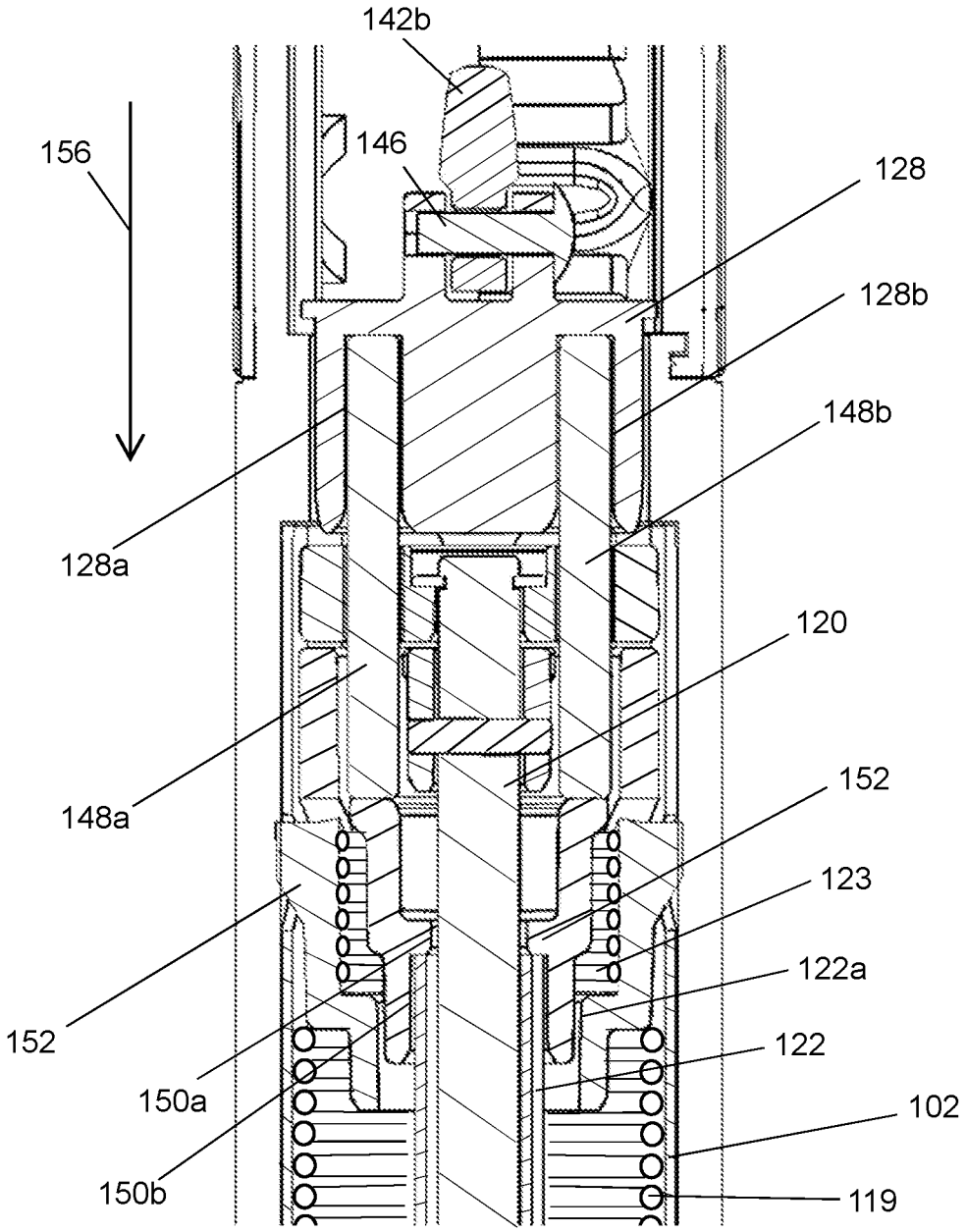
FIG. 6 is an expanded cross section partial view of the actuating assembly of the exemplary walking cane shown in FIG. 2 as generally indicated by box 6 in FIG. 2.
Figure 7:
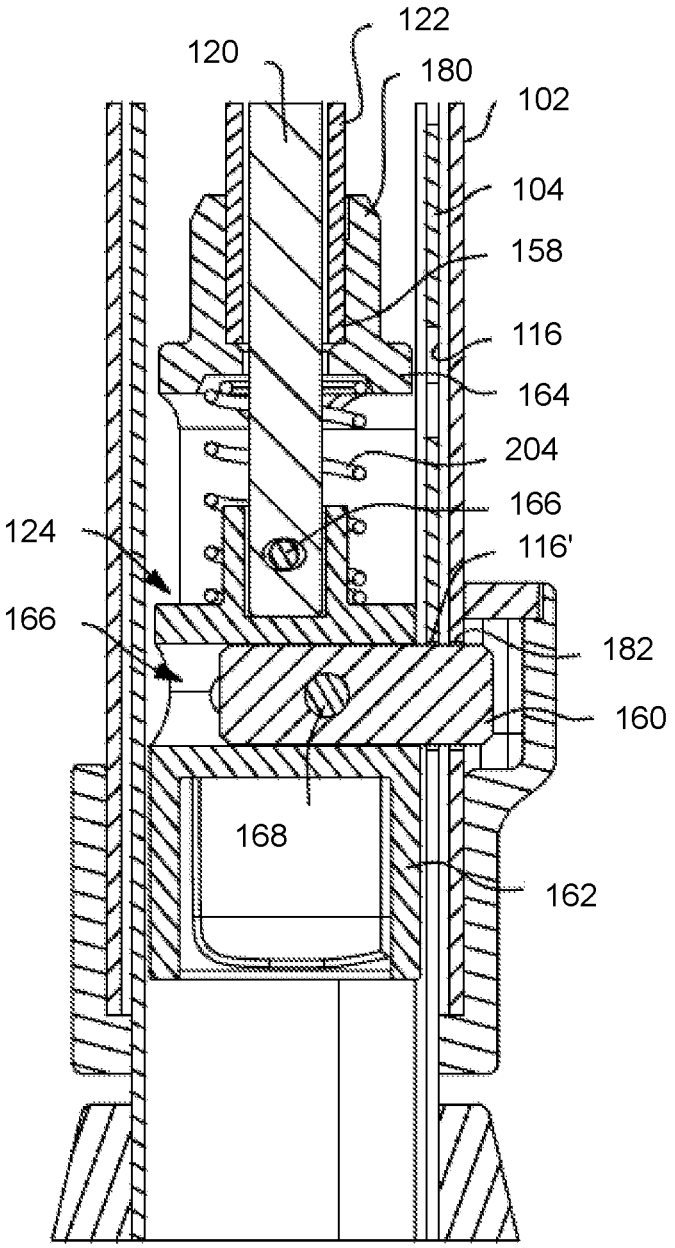
FIG. 7 is an expanded cross section partial view of an embodiment of a pin assembly of the exemplary walking cane shown in FIG. 2 as generally indicated by box 7 in FIG. 2.

With additional reference to FIGS. 5-7, walking cane 100 includes a translating rod assembly 118 having a central fixed rod 120 and a concentrically mounted translating member 122. Translating rod assembly 118 extends between actuation assembly 110 proximate top end 108 of outer tube 102 to pin assembly 124 proximate bottom end 109 of outer tube 102. Translating rod assembly 118 may further include height spring 119 and lower bushing 121, as will discussed in greater detail below. To effectuate translation of translating member 122, actuation assembly 110 may further include a linkage 126, rod driver 128, button post 130 and link arm 132, as shown in FIGS. 6 and 8-9 and described in greater detail below.

With additional reference to FIGS. 12 and 13, linkage 126 may be movably mounted within handle portion 106. By way of example and without limitation thereto, linkage 126 may be pivotally mounted to handle portion 106 via linkage pin 134. Linkage 126 may further include a pair of lobes 126*a*, 126*b*. Linkage lobe 126*a* may be coupled to button post 130, such as via a button pin 136 within button post aperture 138, while linkage lobe 126*b* may be coupled to link arm 132, such as via link arm pin 140 within link arm cap 142*a* mounted on first end 132*a* of link arm 132. Button post 130 may be integrally form within actuating button 112 or may be formed on a button insert 144 which is configured to be securely seated within actuating button 112. Use of button insert 144 may allow for cane customization through swapping of interchangeable buttons 112. Second end 132*b* of link arm 132 may then be mounted to rod driver 128, such as via link arm cap 142*b* and driver pin 146. Rod driver 128 may include a pair of driver cylinders 128*a*, 128*b* which are adapted to receive respective drive posts 148*a*, 148*b* (see FIG. 8).

As shown most clearly in FIG. 8, actuation assembly 110 may further include a button travel block 150 having an annular ledge 152 defining a first block aperture 150*a* and a second block aperture 150*b*. Aperture 150*a* is dimensioned to slidably receive fixed rod 120 therethrough while being too small to permit passage of translating member 122 therein. Aperture 150*b* is dimensioned to receive translating member 122 therein such that upper terminal end 122*a* of translating member 122 abuts and engages with annular ledge 152 of button travel block 150.

Thus, as shown in FIG. 8, application of an actuation force (generally in a downward direction designated by arrow 156, such as through pressing of actuation button 112 by a user's thumb or finger) drives button post 130 against linkage 126 to thereby pivot linkage 126 and cause linkage 126 to drive link arm 132 against rod driver 128, which in turn drives rod driver 128 downward (i.e., in the direction of arrow 156). Rod driver 128 may then engage and translate drive posts 148*a*, 148*b* downward against button travel block 150. Annular ledge 152 of button travel block 150 may then engage upper terminal end 122*a* of translating member 122 so as to drive translating member 122 in the direction of the actuation force (i.e., downward as indicated by arrow 156). Downward translation of button travel block 150 also operates to compress button spring 123 between button travel block 150 and spring cap 152. Button spring 123 may then reset actuation assembly 110 following release of actuation force against actuation button 112.

Returning now to FIGS. 5-7, along with FIGS. 10-11 and 14-15, the downward travel of translating member 122, upon application of actuation force 156 described above, causes distal end 158 of translating member 122 to engage pin assembly 124. Pin assembly 124 includes a pin 160, pin carrier block 162 and lower pin travel block 164. Pin carrier block 162 is secured to distal end 121 of central fixed rod 120, such as via a mounting pin 166. Pin 160 is slidably mounted within pin bore 166 defined by pin carrier block 162. Lateral travel of pin 160 is confined by lock pin 168 inserted within lock pin aperture 170 with lock pin ends 172 reciprocally traveling within respective carrier slots 174 defined within sidewalls 176 of pin carrier block 162.

Lower pin travel block 164 is slidably mounted to pin carrier block 162, with lower pin travel block 164 defining travel slots 178 which are also configured to receive lock pin ends 172 therein. Travel slots 178 are oriented at an angle with respect to carrier slots 174. In one aspect of the present invention, carrier slots are generally horizontally oriented with travel slots 178 angled thereto when walking cane 100 is held vertically. Top portion 180 of lower pin travel block 164 engages distal end 158 of translating member 122. With additional reference to FIGS. 14 and 15, as translating member 122 is driven downward, as described above, distal end 158 drives against top portion 180 such that lower pin travel block 164 is also driven downward. As lower pin travel block 164 moves downwardly, pin 160 travels within carrier slots 174 and travel slots 178. Because carrier slots 174 and travel slots 178 are oriented at an angle, pin 160 is drawn into pin carrier block 162 (see FIG. 15). Drawing pin 160 into pin carrier block 162 unencumbers pin hole 182 defined within outer tube 102 (and, optionally, selected aperture 116' within inner tube 104). With pin hole 182 clear of pin 160, outer tube 102 and inner tube 104 may then be slidably translated with respect to one another so as to extend or shorten the length of walking cane 100, as desired.

With reference to FIGS. 5-7 and 12-15, once pin hole 182 is unencumbered of pin 160, height spring 119 may bias walking cane 100 from the collapsed orientation (FIG. 1) toward the elongate orientation (FIG. 1A). To that end, a first end 184 of height spring 119 may be seated against bottom end 186 of spring cap 126 while the opposing second end 188 of height spring 119 seats within a recess 190 of lower bushing 121. Lower bushing 121 may generally comprise a bushing body 192 and outwardly extending upper collar 194. A central bore 196 is dimensioned to allow passage of central fixed rod 120 and translating member 122 therethrough. Bushing body 192 is dimension to be snuggly received within inner tube 104 while upper collar 194 is dimension to be received within outer tube 102. Bushing body 192 and upper collar 194 form an inner step 198 which, together, define recess 190. Bushing body 192 and upper collar 194 further form an outer step 200 having an outer periphery slightly smaller than the internal dimensions of outer tube 102. Outer step 200 may then seat upon top edge 202 of inner tube 104. Thus, as spring cap 126 is fixedly secured to outer tube 102, retraction of pin 160 from pin hole 182 in outer tube 102 may decompress height spring 119 such that height spring 119 may bias walking cane 100 toward the elongate orientation.

Pin 160 remains retracted within pin carrier block 162 so long as actuation force 156 is applied to actuation button 112. As described above, release of actuation force 156 causes the potential energy stored within button travel spring 130 to exert a biasing force against flanged top wall 154, thereby returning cap travel block, button post 146, actuation button 112 and button travel spring 130 to their original rest positions as shown in FIG. 12. Similarly, pin assembly 124 may also include a pin assembly spring 204 located between pin carrier block 162 and lower pin travel block 164. Thus, when lower pin travel block 164 is driven downward by translating member 122, potential energy is stored within pin assembly spring 204. Upon release of actuation force 156, the potential energy stored within pin assembly spring 204 may the bias lower pin travel block 164 upward until lower pin travel block 164 returns to its original position (see FIG. 14). The upward travel of lower pin travel block 164 operates to reverse translate translating member 122 upward because translating member 122 is no longer forcibly engaged by button post 146. Upward travel of lower pin travel block also operates to drive pin 160 outwardly of pin carrier block 162 such that pin 160 may engage an aperture 116 in inner tube 104, and, when properly corresponding, with pin hole 182 in outer tube 102 so as to lockingly set walking cane 100 at the selected length.

To shorten walking cane 100, i.e., adjust length from an intermediate or the elongate orientation toward or to the collapsed orientation, an actuation force is applied to actuation button 112 to retract pin 160 from pin hole 182 as described above. With pin hole 182 unencumbered, inner tube 104 may be slidably directed into outer tube 102 while compressing height spring 119. The actuation force may then be removed whereby pin 160 will be directed to the extended position and pass through a newly selected aperture 116' and pin hole 182 to lock walking cane 100 at the selected shortened length.

It should be noted that while the above exemplary embodiments included a walking cane having an outer tube with a pin hole and an inner tube with a plurality of apertures, additional embodiments may include an outer tube with a plurality of apertures and an inner tube with a pin hole, and that such alternative embodiments are part of the instant application.

Although the present invention has been described in considerable detail with reference to certain aspects thereof, other versions are possible. Therefore, the spirit and scope of the appended claims should not be limited to the description of the aspects contained herein.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A height adjustable walking cane selectively positionable between a collapsed orientation, an elongate orientation and a plurality of intermediate orientations therebetween, comprising:

a) an outer tube having a top end and a bottom end and defining a pin hole proximate said bottom end, and further including a handle mounted to said top end of said outer tube;

b) an inner tube slidably received within said outer tube, said inner tube having an inner tube wall defining a plurality of apertures therethrough;

c) a translating rod assembly having a central fixed rod and a concentrically mounted translating member;

d) an actuating assembly including an actuating button proximate said top end of said outer tube and coupled to a first end of said translating member, wherein said actuating assembly resides within at least a portion of said handle; and e) a pin assembly located at said bottom end of said outer tube and comprising a pin adapted to selectively reciprocally translate between an extended position wherein said pin engages a selected aperture of said plurality of apertures defined within said inner tube wall and said pin hole defined in said outer tube, and a retracted position wherein said pin disengages from said pin hole defined in said outer tube, wherein said actuating assembly further includes:

i) a linkage pivotally mounted to the portion of the handle;

ii) a rod driver having a first driver end coupled to said translating member;

iii) a button post having a first post end coupled to said actuating button and a second post end coupled to said linkage; and iv) a link arm having a first link end coupled to said linkage and a second link end coupled to said rod driver, wherein said handle mounted to said top end of said outer tube slidably secures said actuating button therein, and wherein application of an actuation force upon said actuating button drives said button post against said linkage thereby pivoting said linkage and causing said linkage to drive said link arm against said rod driver whereby said rod driver engages said translating member and causes said pin to move from said extended position to said retracted position such that said inner tube slidably translates within said outer tube.

2. The height adjustable walking cane of claim 1, wherein said handle includes a handle grip portion disposed at an angle relative to a longitudinal axis of said outer tube.

3. The height adjustable walking cane of claim 1, wherein said handle includes a button cover to prevent unwanted actuation of said actuating button.

4. The height adjustable walking cane of claim 1, wherein said actuating assembly further includes a button spring between said button and said linkage, said button spring biasing said button to an extended button rest position when said actuation force is not applied to said actuating button.

5. The height adjustable walking cane of claim 1, wherein said pin assembly further includes a pin carrier block fixedly mounted to a distal end of said central fixed rod, wherein said pin carrier block includes a pin bore dimensioned to slidably receive said pin therein and a lock pin passing through a lock pin aperture defined within said pin, wherein opposing ends of said lock pin are configured to travel within respective carrier slots defined within the pin carrier block.

6. The height adjustable walking cane of claim 5, wherein said pin assembly further includes a lower pin travel block coupled to a second end of said translating member, wherein said lower pin travel block defines travel slots therein, wherein said opposing ends of said lock pin are further configured to travel within respective travel slots within said lower pin travel block.

7. The height adjustable walking cane of claim 6, wherein said pin assembly further includes a pin assembly spring between said pin carrier block and said lower pin travel block, said pin assembly spring biasing said lower pin travel block to a first position.

8. The height adjustable walking cane of claim 6, wherein said translating rod assembly further includes a lower bushing coupled to said pin carrier block and said inner tube, and a height spring mounted between a spring cap of said actuating assembly and said lower bushing, wherein said height spring biases said outer tube and said inner tube from the collapsed orientation toward the elongate orientation when said pin is in said retracted position.

9. The height adjustable walking cane of claim 6, wherein said carrier slots are disposed at an angle relative to said travel slots.

10. The height adjustable walking cane of claim 1, wherein each of said outer tube and said inner tube define a generally D-shaped cross section having a curved portion and a planar portion, wherein said planar portions are adjacent one another when said inner tube is received within said outer tube.

11. The height adjustable walking cane of claim 10, wherein said plurality of apertures defined within said inner tube are located within said planar portion.

* * * * *